US005183017A

United States Patent [19]

Bopp

[11] Patent Number: 5,183,017

[45] Date of Patent: Feb. 2, 1993

[54] AIR FILTER DEVICE FOR AN INTERNAL-COMBUSTION ENGINE

[75] Inventor: Stefan Bopp, Esslingen, Fed. Rep. of Germany

[73] Assignee: Mercedes-Benz AG, Fed. Rep. of Germany

[21] Appl. No.: 836,760

[22] Filed: Feb. 19, 1992

[30] Foreign Application Priority Data

Mar. 22, 1991 [DE] Fed. Rep. of Germany ..... 4109406

[51] Int. Cl.[5] ..... F02B 77/00

[52] U.S. Cl. ..... 123/198 D; 123/198 E; 55/466

[58] Field of Search ..... 123/198 E, 198 D; 55/430, 466, DIG. 14, DIG. 28, 312

[56] References Cited

U.S. PATENT DOCUMENTS

| | | | |
|---|---|---|---|
| 3,212,240 | 10/1965 | Streete | 55/466 |
| 3,838,675 | 10/1974 | Schaeffer | 55/466 |
| 3,884,658 | 5/1975 | Roach | 55/315 |

FOREIGN PATENT DOCUMENTS

| | | | |
|---|---|---|---|
| 2738293 | 3/1979 | Fed. Rep. of Germany . | |
| 903580 | 2/1982 | U.S.S.R. | 123/198 E |
| 1491157 | 11/1977 | United Kingdom . | |
| 2003227 | 3/1979 | United Kingdom . | |

*Primary Examiner*—Noah P. Kamen

*Attorney, Agent, or Firm*—Evenson, Wands, Edwards, Lenahan & McKeown

[57] ABSTRACT

An air filter device is disclosed which includes a dry air filter and a dust precipitator for an internal-combustion engine, having a dust extraction blower in a dust exhaust-air line leading away from the dust precipitator. In order to maintain perfect operation of the internal-combustion engine, in addition to the dust exhaust-air line there is provided an additional exhaust-air line which is connected to the intake side of the motor-driven blower and has a shut-off element which opens in the event of failure of the dust extraction blower.

9 Claims, 1 Drawing Sheet

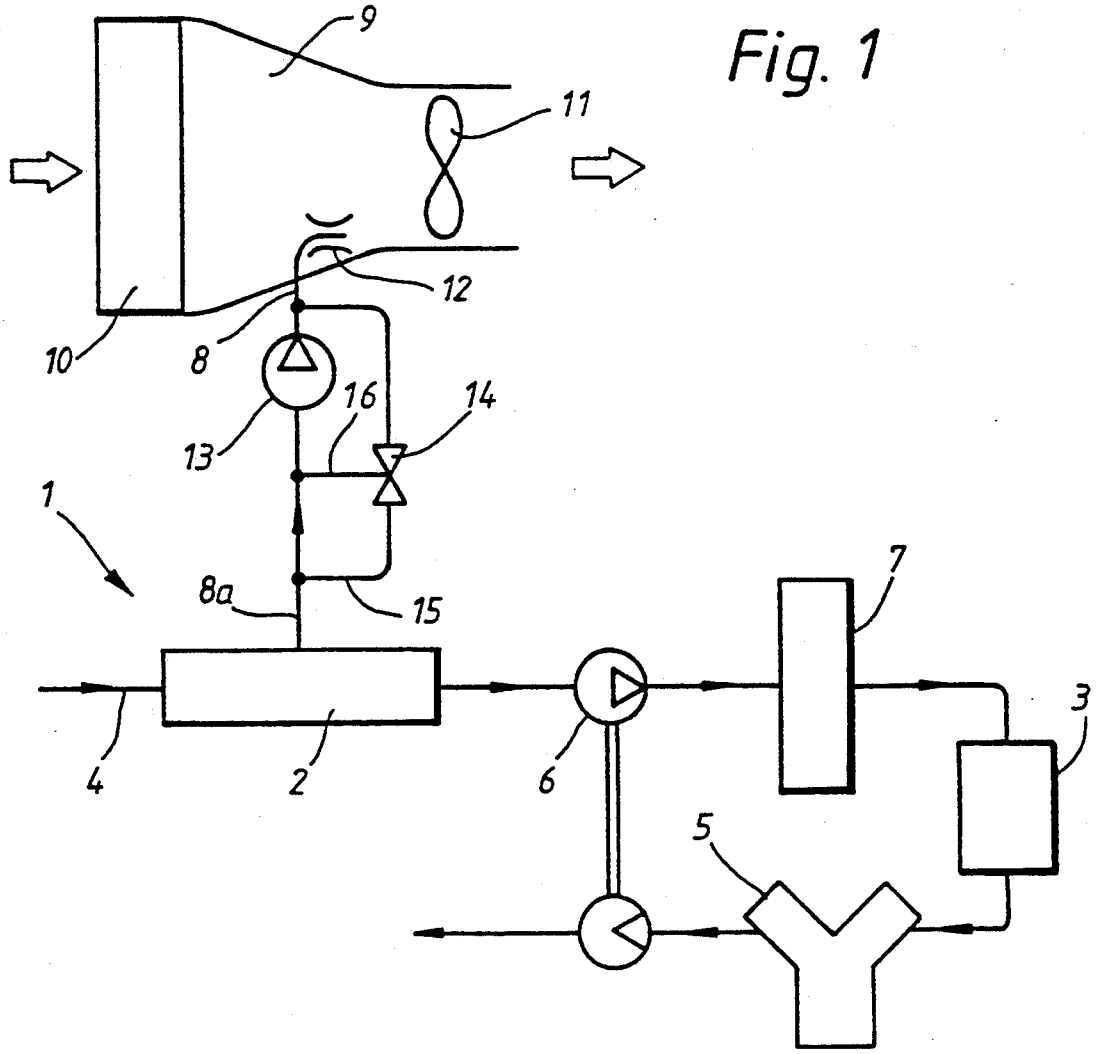
Fig. 1
Fig. 2
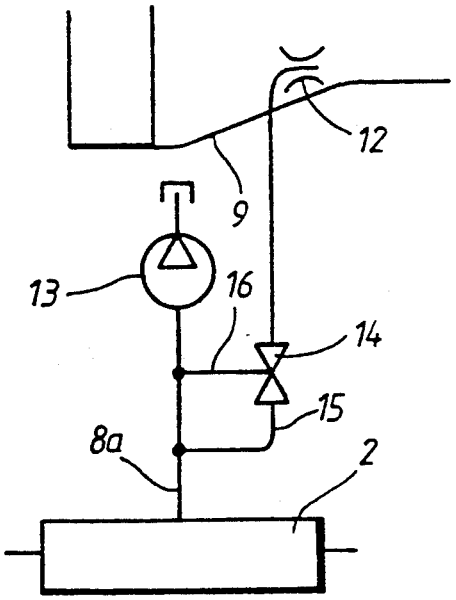
Fig. 3
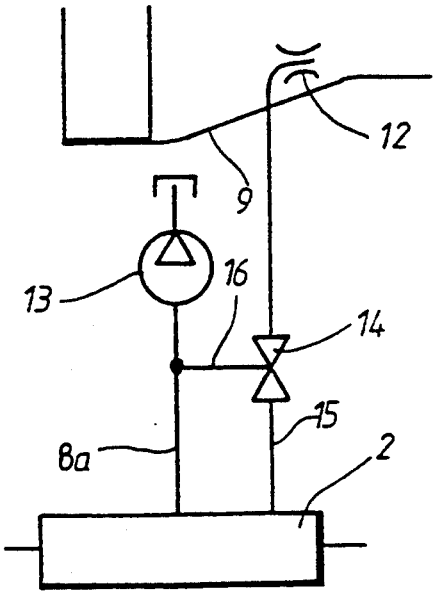

AIR FILTER DEVICE FOR AN INTERNAL-COMBUSTION ENGINE

BACKGROUND AND SUMMARY OF THE INVENTION

The invention relates to an air filter device for an internal-combustion engine of the type including a charge-air compressor, a charge-air cooler, a water-air heat exchanger and a motor-driven blower with a blower hood.

Filter devices which, apart from a dry air filter, are further provided with an upstream dust precipitator or preliminary cyclone precipitator are customary in vehicle operation attended by heavy dust loading.

German Patent Document No. 2,738,293 discloses such an air filter device in which a centrifugal dust precipitator with a dust extraction blower is arranged in a dust exhaust-air line upstream of a dry air filter, in order to ensure dust-free and low-wear operation.

In the case when trouble-free operation of the extraction blower is impaired, or the operation of the extraction blower even fails in the event of a drive defect, the dry air filter, which is usually constructed as a fine filter, can become choked, with the result that the internal-combustion engine stalls because of lack of air.

Moreover, in the case of supercharged internal-combustion engines, severe wear on the charge-air compressor and blockage of the air ducts in the charge-air cooler can occur.

It is an object of the invention to take measures on an air-filter device of the type referred to above by means of which even in the event of a functional impairment or even failure of the dust extraction blower reliable operation remains guaranteed for the internal-combustion engine even in the case of supercharged internal-combustion engines.

This object is achieved according to preferred embodiments by providing a filter arrangement comprising:

a dust precipitator and a dry air filter in an intake line leading to the internal-combustion engine, a dust extraction blower in a dust exhaust-air line connected to the dust precipitator, an additional exhaust-air line in addition to the dust exhaust-air line which is connected to an intake side of the motor-driven blower, and a shut-off element in the additional exhaust-air line which opens in the event of failure of the dust extraction blower.

The measures according to the invention continue to enable adequate removal of dust even in the event of a defect in the extraction blower, so that driving operation can be maintained without the risk of choking in the intake section of the internal-combustion engine.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic view which shows the subject-matter of the invention with an additional exhaust-air line constructed as a bypass line;

FIG. 2 is a schematic view showing another preferred embodiment of the invention; and FIG. 3 is a schematic view showing yet another preferred embodiment of the invention.

DETAILED DESCRIPTION OF THE DRAWINGS

A filter device 1 comprises a dust precipitator 2 or preliminary cyclone precipitator, as well as a dry air filter 3 in an intake line 4 of a supercharged internal-combustion engine 5. A charge-air compressor 6 with a downstream charge-air cooler 7 is arranged between the dust precipitator 2 and the dry air filter 3, which is constructed as a fine filter.

Leading away from the dust precipitator 2 is a dust exhaust-air line 8 which opens on the intake side into a blower hood 9 between a water-air heat exchanger 10 and a variable-speed motor-driven blower 11. A Venturi tube 12 is constructed in the region of the opening point.

Provided in the dust exhaust-air line 8 is a dust extraction blower 13 which is bypassed by a bypass line 15 having a shut-off element 14.

The dust precipitated in the dust precipitator 2 is led off together with a small part of the combustion air through the dust extraction blower 13. The shut-off element 14 is closed. In the even to failure of the dust extraction blower 13, for example in the event of a defect in the drive, the shut-off element 14 is switched to "open" as a consequence of the change in pressure or owing to the excessively low underpressure in the line section 8*a* of the dust exhaust-air line 8 leading to the dust extraction blower 13. The removal of dust continues to be guaranteed by the underpressure prevailing in the blower hood 9.

Instead of a bypass which bypasses the dust extraction blower 13, the additional exhaust-air line 15 branching off from the line section 8*a* can open directly into the blower hood 9. (FIG. 2)

The additional exhaust-air line 15 can, however, also extend entirely separate from the dust exhaust-air line and directly connect the dust precipitator 2 to the blower hood 9. (FIG. 3)

The opening and closing of the shut-off element 14 in additional exhaust-air line 15 is performed by the pressure which prevails in the line section 8*a* of the dust exhaust-air line 8 leading to the dust extraction blower 13, and which actuates the shut-off element 14 via a control line 16 branching off from the line section 8*a*.

As soon as a specific underpressure is undershot in the line section 8*a* and the shut-off element 14 is switched to "open", the underpressure acting in the blower hood 9 can simultaneously be increased by raising the speed of the motor-driven blower.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Air filter device for an internal-combustion engine of the type including a charge-air compressor, a charge-air cooler, a water-air heat exchanger and a motor-driven blower with a blower hood which directs air from the heat exchanger to the blower, the air filter device comprising:

a dust precipitator and a dry air filter in an internal-combustion engine intake line, a dust extraction blower in a dust exhaust-air line connected to the dust precipitator, an additional exhaust-air line in addition to the dust exhaust-air line which is connected to an intake side of the motor-driven blower, a shut-off element in the additional exhaust-air line, and a shut-off element opening system for opening the shut-off element in the event of failure of the dust extraction blower.

2. Air filter device according to claim 1, wherein the additional exhaust-air line opens into the blower hood at a location between the water-air heat exchanger and the motor-driven blower.

3. Air filter device according to claim 2, wherein one of the dust exhaust-air line and the additional exhaust-air line ends in a Venturi tube arranged in the blower hood.

4. Air filter device according to claim 3, wherein a control line is provided for controlling the shut-off element provided in the additional exhaust-air line as a function of the pressure prevailing in the dust-exhaust-air line leading to the dust extraction blower.

5. Air filter device according to claim 2, wherein a control line is provided for controlling the shut-off element provided in the additional exhaust-air line as a function of the pressure prevailing in the dust exhaust-air line leading to the dust extraction blower.

6. Air filter device according to claim 1, wherein a control line is provided for controlling the shut-off element provided in the additional exhaust-air lien as a function of the pressure prevailing in the dust exhaust-air leading to the dust extraction blower.

7. Air filter device according to claim 1, wherein the dust exhaust-air line opens into the blower hood at a location between the water-air heat exchanger and the motor-driven blower, and wherein the additional exhaust-air line is constructed as a bypass line which bypasses the dust extraction blower.

8. Air filter device according to claim 7, wherein one of the dust exhaust-air line and the additional exhaust-air line ends in a Venturi tube arranged in the blower hood.

9. Air filter device according to claim 7, wherein a control line is provided for controlling the shut-off element provided in the additional exhaust-air line as a function of the pressure prevailing in the dust exhaust-air line leading to the dust extraction blower.

* * * * *